US005716245A

United States Patent [19]

Kameyama et al.

[11] Patent Number: 5,716,245

[45] Date of Patent: Feb. 10, 1998

[54] FEMALE TERMINAL

[75] Inventors: Isao Kameyama; Shigeru Tanaka, both of Shizuoka, Japan

[73] Assignee: Yazaki Corporation, Tokyo, Japan

[21] Appl. No.: 688,118

[22] Filed: Jul. 29, 1996

[30] Foreign Application Priority Data

Jul. 28, 1995 [JP] Japan ..... 7-193585

[51] Int. Cl.[6] ..... H01R 13/11

[52] U.S. Cl. ..... 439/852; 439/851

[58] Field of Search ..... 439/850, 849, 439/852, 845, 851

[56] References Cited

U.S. PATENT DOCUMENTS 5,356,308 10/1994 Toba et al. ..... 439/495

5,540,603 7/1996 Fujiwara ..... 439/850

FOREIGN PATENT DOCUMENTS 2378375 8/1978 France ..... 439/850

6-2570 1/1994 Japan ..... H01R 13/28

*Primary Examiner*—Neil Abrams

*Assistant Examiner*—T. C. Patel

*Attorney, Agent, or Firm*—Sughrue, Mion, Zinn, Macpeak & Seas, PLLC

[57] ABSTRACT

A female terminal includes a resilient contact piece portion which has a front folded portion folded back from a front end of a flat bottom plate portion of a tubular contact portion, an ascending piece portion extending slantingly upwardly from the front folded portion toward a top plate portion of the tubular contact portion, and a descending piece portion extending slantingly downwardly from a distal end of the ascending piece portion toward the bottom plate portion. A free end portion of the descending piece portion is arcuately bent, and is directed toward the front folded portion to form a resilient abutment portion. With this construction, the contact pressure is obtained not only by the reaction forces from the ascending piece portion and the descending piece portion, but also by the reaction force from the resilient abutment portion, and therefore the large contact pressure can be obtained even with the small configuration.

4 Claims, 4 Drawing Sheets

FEMALE TERMINAL

BACKGROUND OF THE INVENTION

1. Field of the Invention

This invention relates to a female terminal having a resilient contact piece portion folded back from a front end of a flat bottom plate portion of a tubular contact portion.

2. Related Art

FIGS. 4 and 5 shows a female terminal 1 analogous to that disclosed in Japanese Utility Model Unexamined Publication No. 6-2570. In these Figures, the female terminal 1 has a resilient contact piece portion 19 folded back from a front end 5*a* of a flat bottom plate portion 5 of a tubular contact portion 3. This resilient contact piece portion 19 includes a front folded portion 7, an ascending piece portion 11 extending slantingly upwardly from the front folded portion 7 toward an inner top plate 9 in the tubular contact portion 3, and a descending piece portion 13 extending slantingly downwardly from a distal end of the ascending piece portion 11.

The front folded portion 7 is formed by folding the front end portion of the bottom plate portion 5 on itself. This front folded portion 7 is pressed by a terminal withdrawal tool 15 or the like as shown in FIG. 6(*a*), and is formed into a predetermined shape as shown in FIG. 6(*b*) so that it will not be damaged. A distal end portion of the descending piece portion 13 is extended toward the rear end, and is bent into an arcuate shape, and is directed toward the top plate 9. With this construction, the descending piece portion 13 can be easily displaced toward the rear end of the bottom plate portion 5.

When a mating terminal (male terminal) is not inserted in the tubular contact portion 3, a gap 17 is formed between the connecting portion, interconnecting the ascending piece portion 11 and the descending piece portion 13, and the top plate 9, When the mating terminal is inserted into this gap 17, the distal end portion of the descending piece portion 13 is displaced toward the rear end, so that the whole of the resilient contact piece portion 19 is flexed toward the bottom plate portion 5, as shown in FIG. 7. By a reaction force of this flexing of the resilient contact piece portion 19, the mating terminal is resiliently held between this contact piece portion 19 and the top plate 9 with a predetermined contact pressure. In this female terminal 1, the ascending piece portion 11 and the descending piece portion 13 of the resilient contact piece portion 19 jointly assume a mountain-like shape, and with this arrangement the predetermined contact pressure can be obtained.

One method of increasing the load under which the mating terminal is resiliently held is to reduce a length L2 (see FIG. 4) from the front end to a load-acting point 21 and a length L3 from the load-acting point 21 to the rear end.

However, if these lengths L2 and L3 are reduced, the amount of flexing of the resilient contact piece portion 19 becomes too large, and it is possible that the resilient contact piece portion 19 has a permanent set in fatigue beyond the stress of the material.

And besides, the load change amount relative to the flexing of the resilient contact piece portion 19 is large, and there is encountered a great influence due to variations in the manufacture, and the stable load can not be obtained.

Therefore, in order to obtain the large load within the stress, it may be proposed to increase the length L1 of the resilient contact piece portion 19 so as to increase the flexing amount. In this case, however, the overall length of the resilient contact piece portion 19 is increased, so that the terminal is increased in overall size, and hence is not suited for a small-size connector.

In order to obtain the large load within the stress, it may also be proposed to increase the thickness of the material sheet and to increase the width thereof, thereby obtaining the required load. In this case, also, the overall size of the terminal is increased.

In order to obtain the large load within the stress, it may be proposed to use a material having a high yield strength and spring properties. In this case, the cost is increased.

Therefore, it has been difficult for the resilient contact piece portion 19 of the above configuration to have a spring performance suited for a small/size connector.

SUMMARY OF THE INVENTION

It is therefore an object of this invention to provide a female terminal which can provide a large contact pressure even with a small configuration, and can be applied to a small-size connector, and is inexpensive.

The above object has been achieved by a female terminal of the invention of claim 1 including a resilient contact piece portion which has a front folded portion folded back from a front end of a flat bottom plate portion of a tubular contact portion, an ascending piece portion extending slantingly upwardly from the front folded portion toward a top plate portion of the tubular contact portion, and a descending piece portion extending slantingly downwardly from a distal end of the ascending piece portion toward the bottom plate portion; wherein a free end portion of the descending piece portion is arcuately bent, and is directed toward the front folded portion to form a resilient abutment portion.

In the present invention, when a mating terminal is inserted into the tubular contact portion, the ascending piece portion is flexed toward the bottom plate portion, and also the descending piece portion is flexed toward the bottom plate portion. At this time, the resilient abutment portion is kept abutted against the bottom plate portion, and moves toward the rear end of the bottom plate portion, and is flexed in accordance with the displacement of the descending piece portion. Then, the mating terminal is resiliently held between the inner wall of the tubular contact portion and the resilient contact piece portion by reaction forces of the flexing of the ascending piece portion and the descending piece portion and also by a reaction force of the flexing of the resilient abutment portion.

Therefore, the contact pressure is obtained not only by the reaction forces from the ascending piece portion and the descending piece portion, but also by the reaction force from the resilient abutment portion, and therefore the large contact pressure can be obtained even with the small configuration.

In the present invention, the resilient abutment portion includes an arcuately-bent, resilient portion, and an abutment end portion formed at a distal end of the resilient portion, and the abutment end portion is abutted against the bottom plate portion, and suppresses the movement of the resilient portion toward a rear end of the bottom plate portion when the ascending piece portion and the descending piece portion are resiliently deformed.

In the present invention, when the mating terminal is inserted into the tubular contact portion, the ascending piece portion is flexed toward the bottom plate portion, and also the descending piece portion is flexed toward the bottom plate portion. When the descending piece portion is flexed toward the bottom plate portion, the abutment end portion of the resilient abutment portion moves toward the rear end of the tubular contact portion. Then, by the reaction forces from the ascending piece portion, the descending piece portion and the resilient portion, the mating terminal is resiliently held in the tubular contact portion with the predetermined contact pressure. At this time, the movement of the abutment end portion toward the rear end of the bottom plate portion is suppressed, and therefore the large reaction force is produced as a result of flexing of the ascending piece portion, the descending piece portion and the resilient abutment portion.

In the present invention, the distance between a connecting portion, interconnecting the ascending piece portion and the descending piece portion, and the resilient abutment portion is larger than the distance between the connecting portion and the front folded portion.

In the present invention, the distance between the connecting portion, interconnecting the ascending piece portion and the descending piece portion, and the resilient abutment portion is larger than the distance between the connecting portion and the front folded portion, and with this construction the stress can be dispersed into the resilient abutment portion, and therefore the stress will not concentrate only on the ascending piece portion and the descending piece portion.

In the present invention, the connecting portion, interconnecting the ascending piece portion and the descending piece portion, defines a peak portion which is the height from the bottom plate portion.

In the present invention, the mating terminal, when inserted into the tubular contact portion, is resiliently held between the inner wall of the tubular contact portion and the peak portion. In this case, the peak portion serves as the load-acting point of the resilient contact piece portion, and the mating terminal is resiliently held between the inner wall of the tubular contact portion and the resilient contact piece portion through the load-acting point by the reaction forces of the flexing of the ascending piece portion, the descending piece portion and the resilient abutment portion.

BRIEF DESCRIPTION OF THE DRAWINGS

FIG. 3(*b*) is an enlarged, cross-sectional view of a portion in FIG. 3(*a*);

FIG. 6(*b*) is a cross-sectional view of the conventional female terminal, showing a condition in which the front end of the resilient contact piece portion is damaged.

DETAILED DESCRIPTION OF THE PREFERRED EMBODIMENTS

Figure 1:
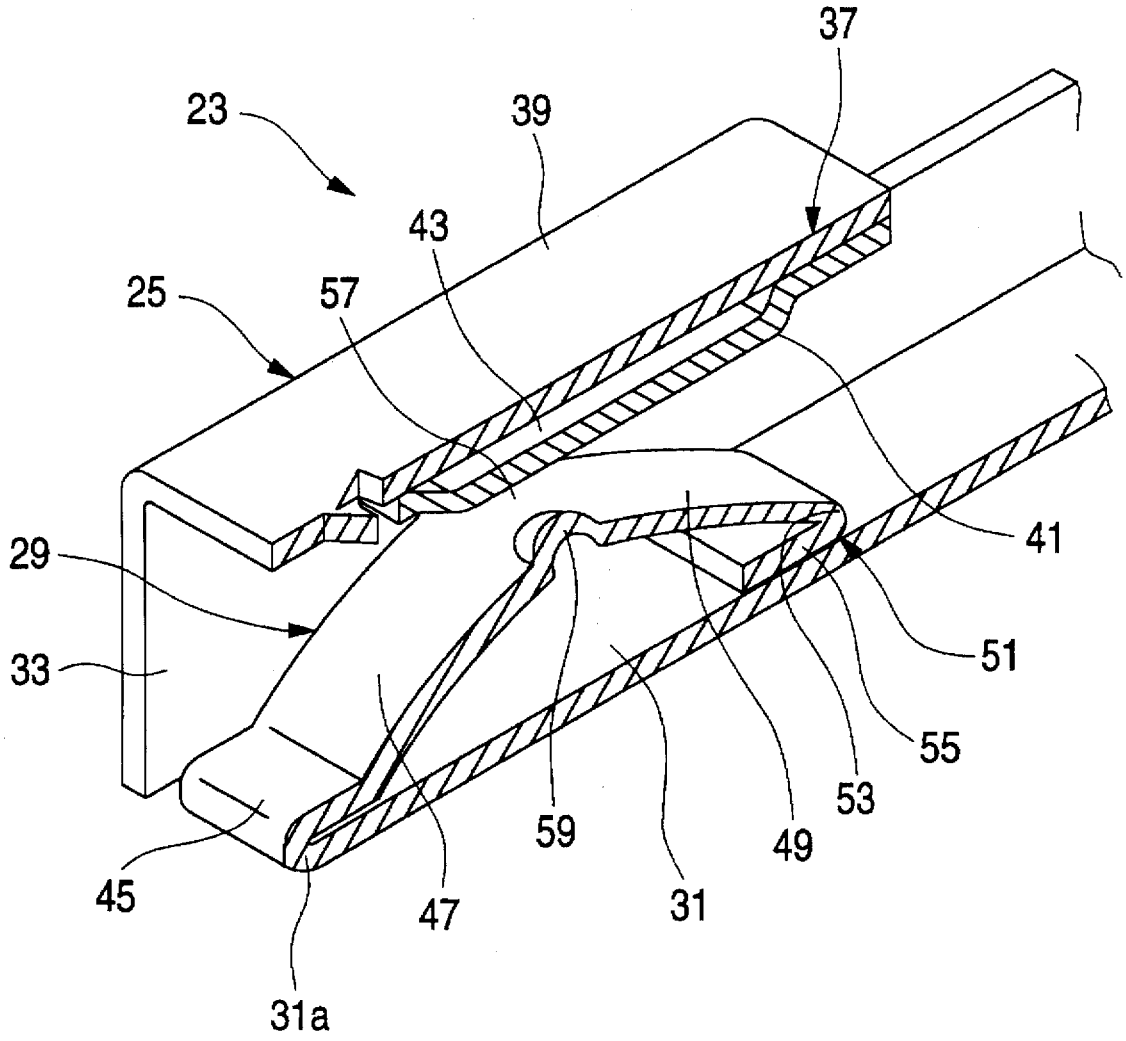
FIG. 1 is a partly-broken, perspective view of a preferred embodiment of a female terminal of the invention, showing the interior thereof.
Figure 2:
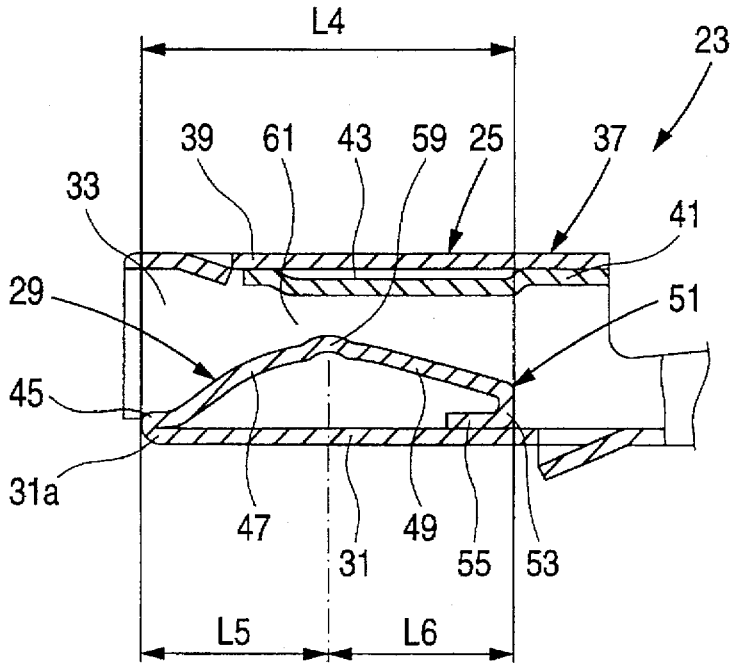
FIG. 2 is a cross-sectional view showing the interior of the female terminal of the invention.

A preferred embodiment of a female terminal of the present invention will now be described with reference to the drawings. FIG. 1 is a partly-broken, perspective view of the female terminal 23, showing the interior thereof, FIG. 2 is a cross-sectional view showing the interior of the female terminal 23, FIG. 3(*a*) is a cross-sectional view showing a resilient contact piece portion 29 when a mating terminal 27 is inserted into a tubular contact portion 25, and FIG. 3(*b*) is an enlarged, cross-sectional view of a portion in FIG. 3(*a*).

As shown in FIG. 1, the female terminal 23 of this embodiment includes the tubular contact portion 25 formed integrally at one end portion thereof, and a wire connecting portion (not shown) formed integrally at the other end portion thereof. The tubular contact piece portion 25 is formed by bending a flat sheet into a rectangular cross-section, and includes a flat bottom plate portion 31, opposed side walls 33 (only one of which is shown in FIG. 1) formed respectively on opposite side edges of the bottom plate portion 31, and a top plate portion 37 facing the bottom plate portion 31. The top plate portion 37 comprises an upper top plate 39 and a lower top plate 41, and a convex contact portion 43 is formed on the lower top plate 41, and is projected toward the bottom plate portion 31. The resilient contact piece portion 29, folded back from a front end 31*a* of the bottom plate portion 31, is provided within the tubular contact portion 25.

The resilient contact piece portion 29 includes a front folded portion 45, folded back from the front end 31*a* of the bottom plate portion 31 upon the bottom plate portion 31, an ascending piece portion 47 extending slantingly upwardly from the front folded portion 45 toward the top plate portion 37 of the tubular contact portion 25, and a descending piece portion 49 extending slantingly downwardly from a distal end of the ascending piece portion 47 toward the bottom plate portion 31. In the resilient contact piece portion 29 of this embodiment, the free end portion of the descending piece portion 49 is bent generally arcuately toward the front folded portion 45 to form a resilient abutment portion 51. This resilient abutment portion 51 includes an arcuately-bent, resilient portion 53, and an abutment end portion 55 which extends from a distal end of the resilient portion 53 toward the front folded portion 45, and is abutted against the bottom plate portion 31.

The front folded portion 45 is provided for preventing the resilient contact piece portion 29 from being damaged when it is pressed by a terminal withdrawal tool or the like. The ascending piece portion 47 and the descending piece portion 49 joint have an arcuate shape projected toward the top plate portion 37, and the overall configuration of the resilient contact piece portion 29 is a mountain-like shape. The connecting portion, interconnecting the ascending piece portion 47 and the descending piece portion 49, defines a peak portion 57 which is the height from the bottom plate portion 31.

A convex portion 59 of a semi-spherical shape is formed at the peak portion 57, and projects toward the top plate portion 37. This convex portion 59 serves as a load-acting point as described later. An insertion space 61 is formed between the load-acting point and the convex contact portion 43, and the mating terminal (male terminal) 27 can be inserted into this insertion space 61. The mating terminal 27, inserted into this insertion space 61, is resiliently held against the convex contact portion 43 by the resilient force of the resilient contact piece portion 29, and hence is resiliently held therebetween.

The resilient portion 53, which is arcuately bent toward the front folded portion 45, is formed at the distal end portion of the descending piece portion 49, and the abutment end portion 55, abutted against the bottom plate portion 31, is formed integrally at the distal end portion of the resilient portion 53.

The distance L6 between the center of the convex portion 59 and the resilient abutment portion 51 is larger than the distance L5 between the front end of the bottom plate portion 31 and the center of the convex portion 59.

The operation of the resilient contact piece portion 29, effected when inserting the mating terminal 27 into the tubular contact portion 25, will now be described.

Before the mating terminal 27 is inserted into the tubular contact portion 25, the resilient contact piece portion 29 has the mountain-like configuration defined by the ascending piece portion 47 and the descending piece portion 49, and the insertion space 61 is formed between the convex portion 59 and the convex contact portion 43. The dimension of this insertion space 61 in the direction of the height is smaller than the thickness of the mating terminal 27.

In this condition, when the mating terminal 27 is inserted into the tubular contact portion 25, the front end the mating terminal 27 abuts against the convex portion 59, and when the mating terminal 27 is further inserted into the tubular contact portion 25, a tapered surface 27*a*, formed at the front end of the mating terminal 27, slides over the convex portion 59, and then a lower surface 27*b* of the mating terminal 27 slides over the convex portion 59. In accordance with this operation, the ascending piece portion 47 is flexed or displaced toward the bottom plate portion 31 about the front folded end 45. When the ascending piece portion 47 is thus flexed toward the bottom plate portion 31, the descending piece portion 49 is also flexed or displaced toward the bottom plate portion 31, as shown in FIG. 3(*a*).

Figure 3:
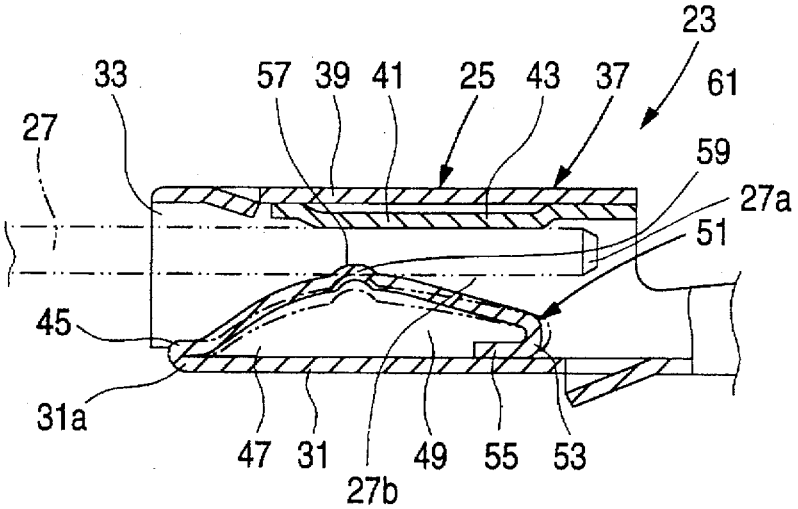
FIG. 3(*a*) is a cross-sectional view of the female terminal of the invention.
Figure 3:
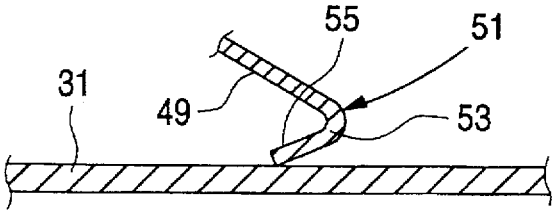
Figure 4:
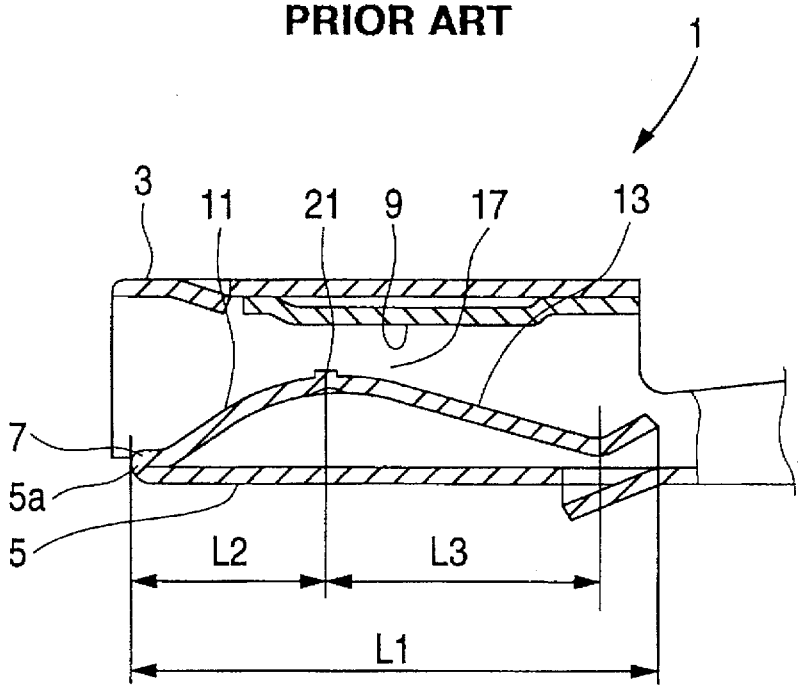
FIG. 4 PRIOR ART
FIG. 4 is a cross-sectional view of a conventional female terminal.
Figure 5:
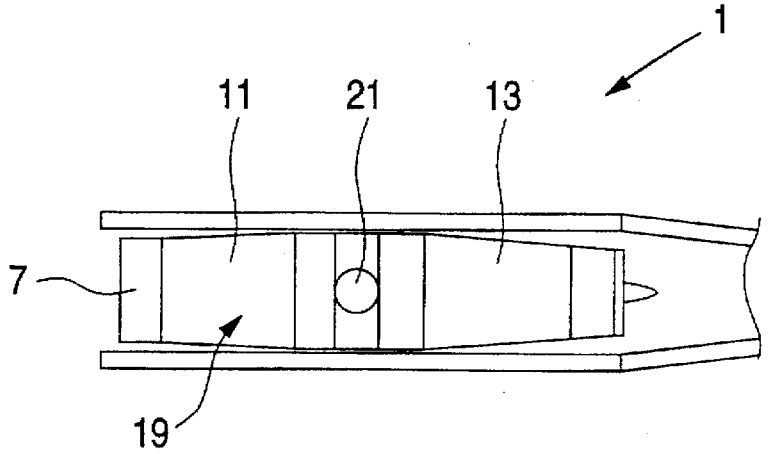
FIG. 5 PRIOR ART
FIG. 5 is a plan view of the conventional female terminal, with a top plate portion removed.
Figure 6:
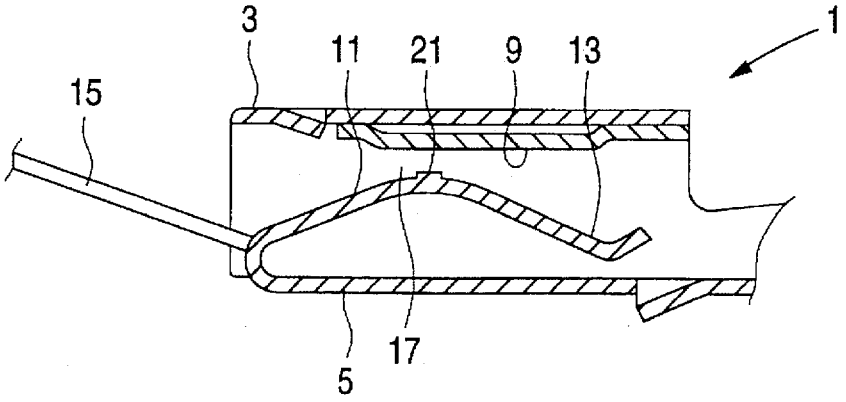
FIG. 6 (a) PRIOR ART
FIG. 6(*a*) is a cross-sectional view of the conventional female terminal, showing a terminal withdrawal tool engaged with a front end of a resilient contact piece portion.
Figure 6:
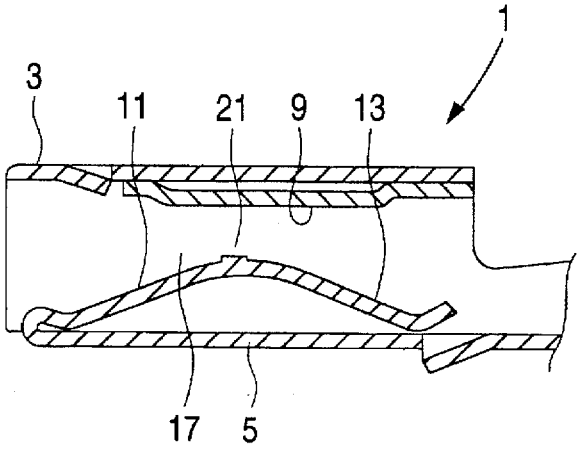
FIG. 6 (b) PRIOR ART
Figure 7:
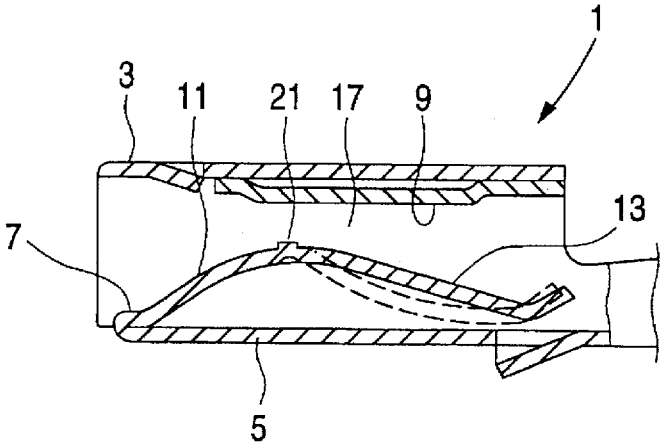
FIG. 7 PRIOR ART
FIG. 7 is a cross-sectional view of the conventional female terminal, showing a descending piece portion in its flexed condition.

At this time, the resilient abutment portion 51 tends to slide toward the rear end of the tubular contact portion 25 in accordance with the flexing of the descending piece portion 49; however, the resilient portion 53 is flexed, thereby suppressing this movement, and that portion of the abutment end portion 55 close to the resilient portion 53 floats off the bottom plate portion 31, and the abutment end portion 55 is inclined with respect to the bottom plate portion 31, as shown in FIG. 3(*b*). As a result, the resilient contact piece portion 29 is prevented from being expanded within the tubular contact portion 25. Then, when the mating terminal 27 is completely inserted into the tubular contact portion 25 as shown in FIG. 3(*a*), the mating terminal 27 is pressed toward the convex contact portion 43 by reaction forces of the flexing of the ascending piece portion 47 and the descending piece portion 49, and the mating terminal 27 is resiliently held with the predetermined pressure.

In this embodiment, the mating terminal 27 is resiliently held by the reaction forces of the flexing of the ascending piece portion 47 and the descending piece portion 49 and also by a reaction force of the flexing of the resilient abutment portion 51, and therefore the contact pressure can be increased as compared with the conventional construction, and the electrical connection reliability can be enhanced.

In the resilient contact piece portion 29 of the female terminal 23 of this embodiment, since the resilient abutment portion 51 is bent toward the front folded portion 45, the overall length thereof will not be increased.

Therefore, the large contact pressure can be obtained even with the small configuration, and this female terminal can be applied to a small-size connector.

Furthermore, since part of the resilient contact piece portion 29 is merely bent toward the front folded portion 45, it can be easily formed into the predetermined shape, and beside it does not need to be formed of a material having high spring properties, and therefore the cost is low.

Because of the provision of the resilient abutment portion 51, the movement of the resilient contact piece portion 29 toward the rear end of the tubular contact portion 25 is suppressed, and therefore the tubular contact portion 25 does not need to be increased in size.

As described above, in the present invention, the contact pressure ie obtained not only by the reaction forces from the ascending piece portion and the descending piece portion, but also by the reaction force from the resilient abutment portion, and this resilient abutment portion is arcuately bent toward the front folded portion, and therefore the large contact pressure can be obtained even with the small configuration.

In the present invention, since the reaction force is produced by the flexing of the resilient portion of the resilient abutment portion, the large contact pressure can be obtained.

In the present invention, the distance between the connecting portion, interconnecting the ascending piece portion and the descending piece portion, and the resilient abutment portion is larger than the distance between the connecting portion and the front folded portion, and with this construction the stress can be dispersed into the resilient abutment portion, and therefore the stress will not concentrate only on the ascending piece portion and the descending piece portion.

In the present invention, the peak portion serves as the load-acting point of the resilient contact piece portion, and the mating terminal is resiliently held between the inner wall of the tubular contact portion and the resilient contact piece portion through the load-acting point by the reaction forces of the flexing of the ascending piece portion, the descending piece portion and the resilient abutment portion. Therefore, the large contact pressure can be obtained.

What is claimed is:

1. A female terminal comprising:

a hollow contact portion comprising a bottom plate and a top plate between which a male terminal is inserted; and a resilient contact piece that protrudes from said bottom plate so that the male terminal is resiliently held between said resilient contact piece and said top plate, said resilient contact piece comprising:

a front folded portion folded back from a front end of said bottom plate;

an ascending piece portion extending slantingly upwardly from said front folded portion toward said top plate, said ascending piece portion being elastically biased by insertion of the male terminal to generate a first retaining force for retaining the male terminal in said female terminal;

a descending piece portion extending slantingly downwardly from a distal end of said ascending piece portion toward said bottom plate, said descending piece portion being elastically biased by insertion of the male terminal to generate a second retaining force for retaining the male terminal in said female terminal; and a resilient abutment portion formed by bending a free end portion of said descending piece portion downwardly toward said bottom plate, and then forwardly toward said front folded portion, said resilient abutment portion comprising:

an arcuately bent resilient portion and an abutment end portion disposed at a distal end of said arcuately bent resilient portion, wherein before the male terminal is inserted in said female terminal, said abutment end portion lies flat on said bottom plate, and when the male terminal is inserted in said female terminal between said contact piece and said top plate, part of said abutment end portion adjacent said arcuately bent resilient portion raises up off said bottom plate so that said abutment end portion is inclined with respect to said bottom plate, whereby said resilient abutment portion is prevented from moving rearwardly toward a rear end of said bottom plate and said arcuately bent resilient portion generates a third retaining force for retaining the male terminal when the male terminal is inserted in said female terminal.

2. A female terminal according to claim 1, in which a connecting portion, interconnecting said ascending piece portion and said descending piece portion, defines a peak portion of said resilient contact piece, said peak portion being spaced apart from said bottom plate by a distance that is greater than a distance between all other portions of said resilient contact piece and said bottom plate.

3. A female terminal according to claim 1, in which the distance between a connecting portion, interconnecting said ascending piece portion and said descending piece portion, and said arcuately bent resilient portion is greater than the distance between said connecting portion and a front end of said front folded portion.

4. A female terminal according to claim 3, in which a connecting portion, interconnecting said ascending piece portion and said descending piece portion, defines a peak portion of said resilient contact piece, said peak portion being spaced apart from said bottom plate by a distance that is greater than a distance between all other portions of said resilient contact piece and said bottom plate.

* * * * *